US007210327B1

(12) United States Patent
Tarpill et al.

(10) Patent No.: US 7,210,327 B1
(45) Date of Patent: May 1, 2007

(54) REDUCED ACTUATION FORCE COMPRESSION ASSEMBLY TOOL

(75) Inventors: Andrew J Tarpill, East Haddam, CT (US); Tadeusz Zagula, Hartford, CT (US)

(73) Assignee: Capewell Components Company, LLC, Cromwell, CT (US)

( * ) Notice: Subject to any disclaimer, the term of this patent is extended or adjusted under 35 U.S.C. 154(b) by 85 days.

(21) Appl. No.: 11/007,822

(22) Filed: Dec. 8, 2004

(51) Int. Cl.
*H01R 43/042* (2006.01)

(52) U.S. Cl. ..... 72/409.12; 29/751; 81/363

(58) Field of Classification Search ..... 72/409.12, 72/409.14; 29/751; 81/355, 357, 373, 376, 81/362, 363, 352, 367
See application file for complete search history.

(56) References Cited

U.S. PATENT DOCUMENTS

| | | | | |
|---|---|---|---|---|
| 172,365 | A | 1/1876 | Adams et al. | |
| 443,312 | A | 12/1890 | Bode | |
| 552,400 | A | 12/1895 | Spires | |
| 1,813,971 | A | 7/1931 | Taylor | |
| 1,879,058 | A | 9/1932 | Brockman | |
| 1,904,903 | A | 4/1933 | Sweet | |
| 2,202,894 | A | 6/1940 | Bihler | |
| 2,333,120 | A | 11/1943 | Parker | |
| 2,852,841 | A | 9/1958 | Ballard et al. | |
| 3,094,774 | A | 6/1963 | Nazarow et al. | |
| 3,226,968 | A | 1/1966 | Holmes | |
| 3,757,408 | A | 9/1973 | Shemtov | |
| 3,793,693 | A | 2/1974 | Levak | |
| 4,136,549 | A | 1/1979 | Lytle et al. | |
| 4,345,361 | A | 8/1982 | Baumann | |
| 4,483,056 | A | 11/1984 | Schwalm et al. | |
| 4,509,244 | A | 4/1985 | Houck et al. | |
| 4,559,691 | A | 12/1985 | Mannhart et al. | |
| 4,589,271 | A | 5/1986 | Laux | |
| 4,691,905 | A | 9/1987 | Tamura et al. | |
| 4,794,780 | A | 1/1989 | Battenfeld | |
| 4,809,534 | A * | 3/1989 | Osborn | 72/31.1 |
| 4,932,091 | A | 6/1990 | Krzyzanski | |
| 5,040,288 | A | 8/1991 | Nilsson | |
| 5,105,648 | A | 4/1992 | Steiner et al. | |

(Continued)

FOREIGN PATENT DOCUMENTS

| | | |
|---|---|---|
| DE | 24 29 180 | 6/1974 |

(Continued)

OTHER PUBLICATIONS

Augat Communications Division LRC Product, Installation & Product Data Handbook; LRC Electronics, Inc. Box 111, Horseheads, NY 14845,6/92,5M; pp. 1-123 plus cover page, Jun. 1992.

(Continued)

*Primary Examiner*—Daniel C. Crane
(74) *Attorney, Agent, or Firm*—DeLio & Peterson, LLC

(57) ABSTRACT

A compression assembly hand tool for attaching a connector to a cable by axially compressing the connector has a reduced actuation force to operate the tool. Increased leverage is achieved through the use of a long swing arm link having one end connected via a first pivot directly to the tool body and the other end connected via a second pivot to a handle. The handle is connected to drive a plunger via a third pivot.

26 Claims, 2 Drawing Sheets

U.S. PATENT DOCUMENTS

| | | | | |
|---|---|---|---|---|
| 5,113,474 | A | 5/1992 | Slaney et al. | |
| 5,138,864 | A | 8/1992 | Tarpill | |
| 5,392,508 | A | 2/1995 | Holliday et al. | |
| 5,435,167 | A | 7/1995 | Holliday et al. | |
| 5,596,800 | A | 1/1997 | Holliday et al. | |
| 5,647,119 | A | 7/1997 | Bourbeau et al. | |
| 5,934,137 | A | 8/1999 | Tarpill | |
| 6,820,326 | B1 * | 11/2004 | Tarpill et al. | 29/751 |
| 6,948,234 | B1 * | 9/2005 | Steiner | 29/751 |

FOREIGN PATENT DOCUMENTS

| | | | |
|---|---|---|---|
| GB | 2 081 629 | A | 2/1982 |

OTHER PUBLICATIONS

New Product Release-PT-5000 Pocket Terminx®, The Cutting Edge, Cable Prep Cable TecExpo Edition Issue 5, Spring 1997.

Compression Tool, Broadband Systems & Design, a Gordon Publication, Apr. 1997, vol. 3, No. 3.

Compression Tool, Communications Technology, A CT Publications Product, Sep. 1996.

TERMINX®,The Next Generation In Cable Termination Tools, Cable Prep.

* cited by examiner

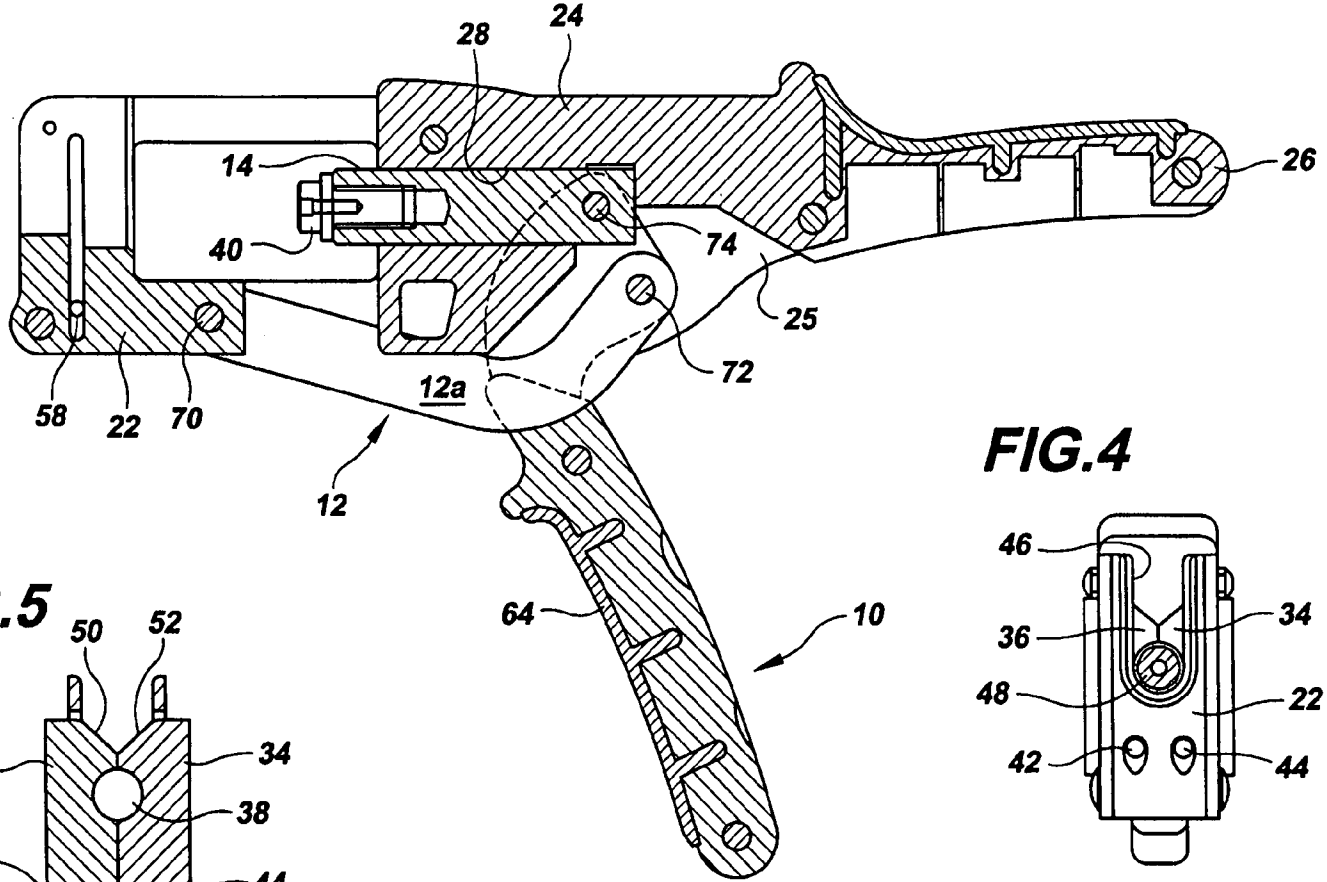
FIG.3
FIG.4
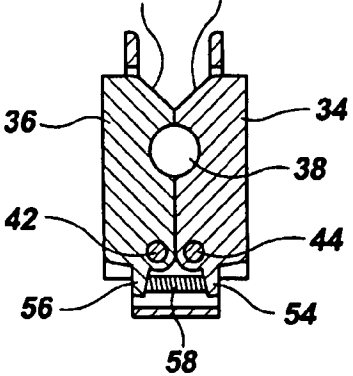
FIG.5

REDUCED ACTUATION FORCE COMPRESSION ASSEMBLY TOOL

BACKGROUND OF THE INVENTION

1. Field of the Invention

This invention relates to hand tools for attaching connectors to coaxial cables by compressing the connector in a direction parallel to the axis of the cable. More specifically, the present invention relates to hand operated tools that reduce the force the operator of the tool must apply in order to achieve the required axial compression of the connector.

2. Description of Related Art

Coaxial cable is widely used to carry radio and television signals, digital data and the like. A major user of coaxial cable is the cable television industry, which uses coaxial cable to carry the signal from a central location to each subscriber.

To make the many connections required for the cable television network requires the installation of numerous coaxial cable connectors. To avoid any interruption in service, it is critical that the connectors be applied properly. Many problems with poor signal quality that require expensive service calls are the result of a connector that was initially installed incorrectly.

Coaxial cable connectors come in a variety of designs, and are attached in a correspondingly wide variety of ways with various tools. However, an increasingly popular connector design is secured to the prepared end of the coaxial cable by axially compressing the connector. For a good connection, it is desirable that the tool be able to apply a relatively high level of axial compression force. However, for ease of operation, it is desirable for the actuation force that must be supplied by the operator to be relatively low.

Two prior art compression assembly tools are seen in U.S. Pat. Nos. 5,934,137 and 6,820,326 owned by the assignee of this application. In each of these tools, and in other similar tools of the prior art, a plunger is driven by a handle that rotates on a pivot connecting the handle directly to the body of the tool. In the tools referred to above, the rotary motion of the handle is transferred to the plunger through a relatively short link connected between the handle and the plunger. In other designs the handle may include a cam that drives the end of the plunger through sliding contact.

In addition to a low actuation force, and a high compression force, the tool must be able to move the plunger sufficiently far to fully compress the connector. Although the tools of the prior art are effective and capable of compressing connectors, it is desired to reduce the actuation force even more.

Another object of the present invention is to provide a compression assembly tool for axially compressing at least two different sizes of electrical connectors onto coaxial cables It is yet another object of the present invention to provide a compression assembly tool that can be produced inexpensively.

A further object of the invention is to provide a compression tool that maintains the axis of the coaxial cable in accurate alignment with the axis of the plunger.

SUMMARY OF THE INVENTION

The above and other objects and advantages, which will be apparent to those skilled in the art, are achieved in the present invention which is directed to, in a first aspect, a compression assembly tool for attaching a connector to a cable by axially compressing the connector. The compression assembly includes a body having an open portion defining a compression region for receiving the connector, a first pair of split base supports attached to the body at an end of the compression region, the first pair of split base supports defining a split base opening for receiving the cable and a perimeter of the split base opening acting to support an end of the connector as the connector is compressed, a handle, a plunger mounted for longitudinal sliding motion relative to the body, the plunger being driven by the handle between an extended position to axially compress the connector and a retracted position to allow the connector to be removed from the compression region and a swing arm link. The swing arm link is pivotally connected to the body through a first pivot and pivotally connected to the handle through a second pivot. The plunger is pivotally connected to the handle through a third pivot.

The first pivot is farther from the second pivot than the third pivot, preferably at least twice as far from the second pivot as the third pivot. The second pivot moves from a position offset from an axial centerline of the plunger to a position substantially on the axial centerline of the plunger as the handle rotates around the third pivot.

The swing arm link may be a single link or a pair of opposed swing arm links. The swing arm link includes a first arm section and an angled second arm section, the first pivot connecting the first arm section to the body and the second pivot connecting the second arm section to the handle.

The body of the tool includes a pair of opposed body plates separated by a nose block, the nose block including a U-shaped opening for receiving the cable. The first pair of split base supports are pivotally attached to the body through a pair of corresponding base support pivots. The first pair of split base supports preferably include a corresponding pair of split base stops, the split base stops being located on an opposite side of the pivotal attachment to the body from the split base opening for the cable.

In another aspect of the invention, the compression assembly tool further includes a spring urging the pair of split base stops apart and into contact with the body, the contact between the body and each split base stop defining a final predetermined location for each split base stop independent of the position of the other split base stop.

The handle preferably is formed by first and second handle plates extending outward from a gripping end of the handle and the third pivot extends from the first handle plate through the plunger to the second handle plate. The body of the tool includes a pair of opposed body plates separated by a nose block and a body block, the nose block and body block being located on opposite sides of the compression region, each body plate having a compression region opening defining an O-frame on each side of the compression region. The first pivot is located closer to the split base supports than the second or third pivots.

In still another aspect of the invention which produces the desired low actuation force, the plunger has a front contact surface defining a moving plunger contact plane as the plunger moves from the retracted position to the extended position. The first pivot is located on an opposite side of the plunger contact plane from the second and third pivots when the plunger is in the retracted position.

The body of the tool includes a pair of opposed body plates separated by a nose block and the nose block includes a pair of split base slots for receiving the split base supports and at least one corresponding pair of split base guides adjacent to the split base slots and extending outward from the nose block and into engagement with the opposed body plates. The first pair of split base supports are pivotally attached to the body through a first pair of corresponding base support pivots and the second pair of split base supports are pivotally attached to the body through a second pair of corresponding base support pivots.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 3 is a cross sectional view of the compression assembly tool of the present invention taken along the central plane of the tool. The tool is shown from the left side and the handles are open with the plunger retracted.

FIG. 4 is a front elevational view of the compression assembly tool in FIG. 1.

FIG. 5 is a detail view of the split base supports showing the spring that biases the split base supports closed, the pivots for the split base supports and the operation of the split base stops that independently bring the split base supports to a desired final position.

DESCRIPTION OF THE PREFERRED EMBODIMENT(S)

In describing the preferred embodiment of the present invention, reference will be made herein to FIGS. 1–6 of the drawings in which like numerals refer to like features of the invention.

Figure 2:
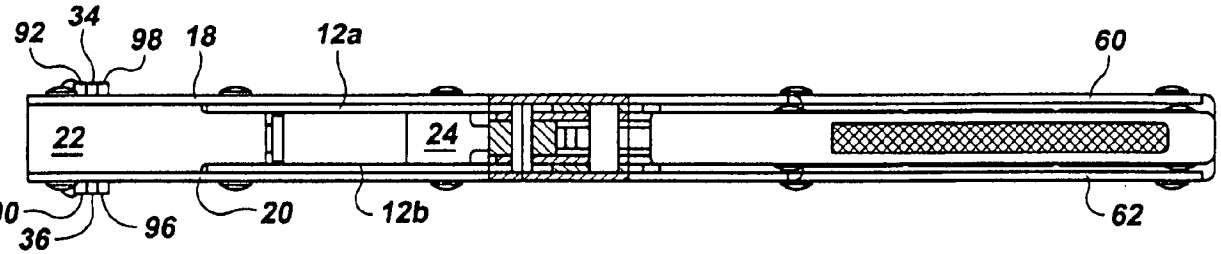
FIG. 2 is a bottom plan view of the compression assembly tool in FIG. 1.
Figure 1:
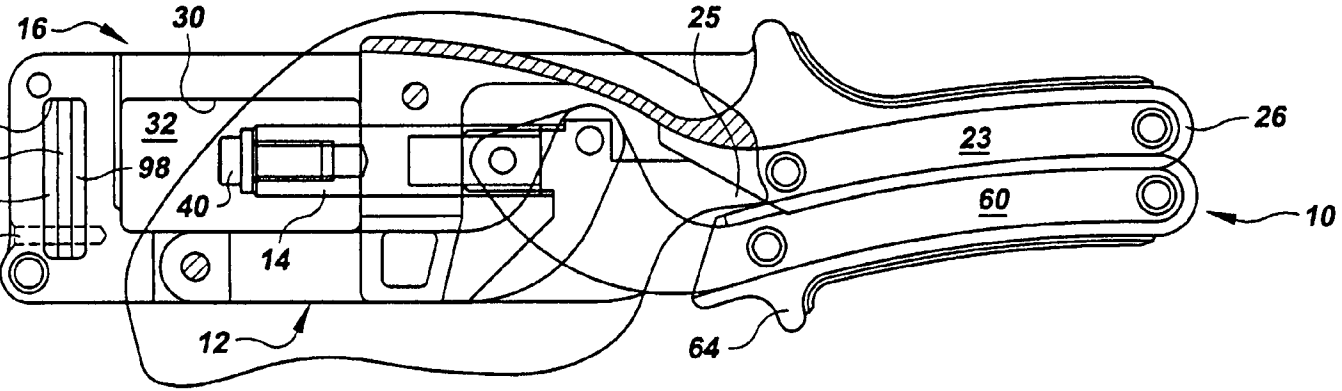
FIG. 1 is a left side elevational view of the compression assembly tool of the present invention, with the central region of the tool shown in section. The handles are closed and the plunger is extended.
Figure 6:
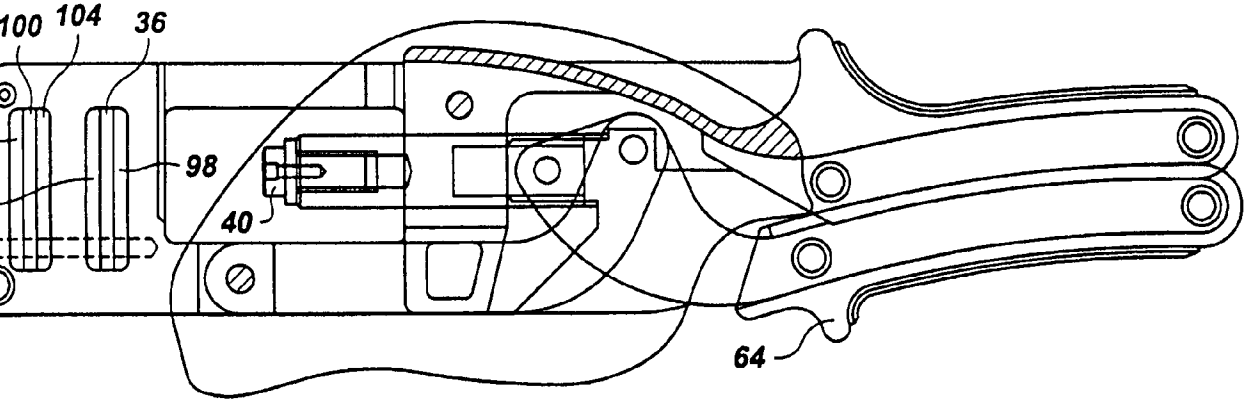
FIG. 6 is a left side elevational view of a second embodiment of the present invention showing two pairs of split base supports. The handles are closed and the plunger is extended.

Referring to FIGS. 1–3, the compression assembly tool of the present invention includes a handle 10, a swing arm link 12 composed of first and second swing arm links 12*a*, 12*b* and a plunger 14 that slides axially between retracted (FIG. 3) and extended (FIG. 1) positions as handle 10 moves between open (FIG. 3) and closed (FIG. 1) positions.

The body of the tool 16 is formed by a pair of opposed body plates 18, 20 (see FIG. 2), a nose block 22 and a body block 24. The body plates sandwich the nose and body blocks between them and the complete assembly is held together by rivets. The body plates 18, 20 include integral handle extensions 23, 25 located on opposite sides of an integral handle extension 26 of the body block 24. The body block 24 also includes a cylindrical plunger opening that holds the plunger 14 and allows it to slide axially between the retracted position in FIG. 3 and the extended position in FIG. 1.

The opposed body plates 18, 20 include corresponding compression region openings 30 providing access to the compression region 32 located between the nose block 22 and the body block 24. The opposed body plates 18, 20 and the compression region openings therein form an O-frame design for the tool which is lightweight and structurally rigid. This design supports the nose block and allows the tool to resist the compression force as a connector is compressed between plunger 14 and the opposed pair of split base supports 34, 36 (see FIG. 5).

The split base supports 34, 36 define a split base opening 38 that is slightly larger in diameter than the coaxial cable 48 and slightly smaller in diameter than the base of a connector to be compressed by the tool. The outer perimeter of the split base opening 38 supports the base of the connector during the compression operation while the front of the connector is engaged by the plunger tip 40.

The split base supports 34, 36 pivot outward on pivots 42, 44 allowing the coaxial cable 48 (see FIG. 4) to be inserted between the split base supports. The nose block 22 includes a U-shaped opening 46 that receives the coaxial cable 48. The coaxial cable and connector are inserted into the tool from the top, between the body plates 18, 20 and down into the U-shaped opening 46 of the nose block 22. As the cable contacts angled surfaces 50, 52 of the split base supports, the split base supports pivot open about pivots 42, 44.

Each split base support includes a corresponding split base stop, 54, 56. The split base stop 56 of split base support 36 is located on the opposite side of the pivot 42. Thus, as the split base support 36 moves to the left in FIG. 5, away from the central plane of the tool, the stop 56 moves to the right, towards the central plane of the tool. This pivoting action by the split base supports causes spring 58 to be compressed. As the coaxial cable enters opening 38, spring 58 presses outward against the split base stops and pushes them back into contact with the body, closing the split base supports and the opening 38 around the coaxial cable.

The contact between the body and the split base stops independently defines the correct final position for each split base support to independently bring each split base support to the correct final alignment with the centerline of the tool and coaxial cable.

The moving handle 10 is formed by first and second handle plate 60, 62 and a handle block 64. The handle plate 60, 62 are located on opposite sides of the handle block 64 and again, rivets are used to hold the assembly together in a manner similar to the assembly formed by the body block, the nose block and the opposed body plates. The handle block, nose block and body block are all preferably made of plastic.

FIG. 3 shows the moving handle 10 in the open position with the plunger 14 retracted. Unlike prior art designs, the moving handle 10 of the present invention is not directly supported by the body and does not directly pivot on the body of the tool. Instead, moving handle 10 is supported by the swing arm link 12 and the plunger 14, both of which move relative to the body.

The swing arm link 12 rotates on a first pivot 70 that directly connects the swing arm to the body. The swing arm link 12 is formed by two separate pieces: a first swing arm link 12*a* and a second swing arm link 12*b*. The first and second swing arm links 12*a*, 12*b* are connected to the moving handle 10 via a second pivot 72. The second pivot 72 extends from the first swing arm link 12*a* through the handle plates, 60, 62 to the second swing arm link 12*b*.

The handle plates 60, 62 are located inside the opposed swing arm links 12*a*, 12*b* and on opposite sides of the plunger 14. A third pivot 74 extends from the handle plate 60 through the back of the plunger 14 to the opposed handle plate 62.

The axial motion of the plunger towards the split base supports and the use of a handle to drive the plunger and compress the connector is fundamentally the same as in the prior art compression assembly tools seen in U.S. Pat. Nos. 5,934,137 and 6,820,326. However, the method by which the handle drives the plunger differs significantly in this invention, and that difference allows the present tool to produce a high compression force with a low actuation force.

In the present invention, the swing arm link 12 includes a relatively long and straight arm section connected to the body of the tool by the first pivot 70 and a relatively shorter angled arm section connected to the handle with the second pivot 72. The handle 10 is supported by the two pivots 72, 74, each of which moves relative to the tool body as opposed to prior art designs where the handle pivots on a stationary pivot directly connected to the body. The design shown here with the shaped swing arm link allows the tool to produce a significantly greater compression force while reducing the actuation force that the user must apply to the handle.

This benefit is achieved, in part, by locating the first pivot 70 near the front of the tool and using a moving second pivot 72 connected to the handle 10. The second pivot 72 pivots from an offset position relative to the axis of the plunger 14 (as seen in FIG. 3) to a location behind, and preferably to the far side of the axis of the plunger 14, as seen in FIG. 1. As the handle 10 is rotating around pivot 72, the pivot 72 is moving around pivot 70 located close to the front of the tool. This double-pivoting action provides the desired high compression force with a low actuation force.

As can be seen in FIG. 3, with the handles open and the plunger retracted, the first pivot 70 is located ahead of a plane defined by the front of the plunger 14. Preferably the swing arm link 12 is sufficiently far ahead of the plane defined by the front of the plunger 14 that the axis of the first pivot 70 is also ahead of that plane when the handle is closed as seen in FIG. 1 with the plunger extended.

As the handles are squeezed, the second pivot 72 moves from a position offset from the axial center line of the plunger 14 as seen in FIG. 3 and rotates around the third pivot 74. As the plunger 14 moves to the extended position it compresses the connector which is trapped between the plunger and the split base supports 34, 36.

As can be seen in FIGS. 1 and 3, the first pivot 70 is farther from the second pivot than the third pivot. Preferably, the first pivot is at least twice as far from the second pivot as the third pivot. The first pivot is located closer to the split base supports than the second or third pivots.

The split base supports 34, 36 are held in slots in the nose block 22. The nose block 22 is provided with at least one pair of split base guides 90, 92 that extend outward from the nose block through split base openings 94 in the body plates. In the preferred design illustrated, the nose block 22 includes a second pair of split base guides 96, 98 such that each split base support slides between split base guides. Split base support 34 slides between split base guides 92, 98 and split base support 36 slides between guides 90, 96. The split base guides extend outward through a corresponding split base opening in the body plate and serve to keep the split base supports accurately in the desired plane and transfer the force to the body plates as the connector is compressed.

The split base guides are all formed as an integral piece of the plastic molded nose block 22. Because the split base guides extend outward through openings in the body plates, they help to hold the body together and to transfer compression forces from the nose block to the body plates.

The tool shown in FIGS. 1–5 uses a single pair of split base supports and a plunger to compress a single type of connector corresponding to the tool shown in U.S. Pat. No. 5,934,137. The present invention includes a second embodiment shown in FIG. 6 in which a second pair of split base supports 100 are included. The body block and body plates in this embodiment are extended. The body block includes a second pair of split base guides 102, 104. In other respects the tool operates in essentially the same way as the tool described above.

The operation of a tool with two split base supports is described in U.S. Pat. No. 6,820,326 owned by the assignee of this application. The two split base supports allow a single tool to compress two different types of connectors of two different lengths. When compressing the longer connector, split base supports 100 are active (closed to support the back of the longer connector) and split base supports 36, 34 are open and out of the way.

The second embodiment described above shows two pairs of split base supports that define support planes at two different distances from the plunger. However, three or even more pairs of split bases may be installed in other embodiments of the invention to accommodate a series of progressively longer or shorter connectors.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A compression assembly tool for attaching a connector to a cable by axially compressing the connector, the compression assembly tool comprising:

a body having an open portion defining a compression region for receiving the connector;

a first pair of split base supports attached to the body at an end of the compression region, the first pair of split base supports defining a split base opening for receiving the cable and a perimeter of the split base opening acting to support an end of the connector as the connector is compressed;

a handle;

a plunger mounted for longitudinal sliding motion relative to the body, the plunger being driven by the handle between an extended position to axially compress the connector and a retracted position to allow the connector to be removed from the compression region; and a swing arm link, the swing arm link being pivotally connected to the body through a first pivot and pivotally connected to the handle through a second pivot;

the plunger being pivotally connected to the handle through a third pivot, the first pivot being farther from the second pivot than the first pivot is from the third pivot.

2. The compression assembly tool according to claim 1 wherein the first pivot is at least twice as far from the second pivot as the second pivot is from the third pivot.

3. The compression assembly tool according to claim 1 wherein the second pivot moves from a position offset from an axial centerline of the plunger to a position substantially on the axial centerline of the plunger as the handle rotates around the third pivot.

4. The compression assembly tool according to claim 1 wherein the second pivot moves from a starting position offset from an axial centerline of the plunger through a position substantially on the axial centerline of the plunger to a final position on an opposite side of the axial centerline of the plunger from the starting position as the handle rotates around the third pivot.

5. The compression assembly tool according to claim 1 wherein the swing arm link includes a first arm section and an angled second arm section, the first pivot connecting the first arm section to the body and the second pivot connecting the second arm section to the handle.

6. The compression assembly tool according to claim 1 wherein the body includes a pair of opposed body plates separated by a nose block, the nose block including a U-shaped opening for receiving the cable.

7. The compression assembly tool according to claim 1 wherein the first pair of split base supports are pivotally attached to the body through a pair of corresponding base support pivots.

8. The compression assembly tool according to claim 7 wherein the first pair of split base supports include a corresponding pair of split base stops, the split base stops being located on an opposite side of the pivotal attachment to the body from the split base opening for the cable.

9. The compression assembly tool according to claim 8 further including a spring urging the pair of split base stops apart and into contact with the body, the contact between the body and each split base stop defining a final predetermined location for each split base stop independent of the position of the other split base stop.

10. The compression assembly tool according to claim 1 wherein the swing arm link is a first swing arm link and the compression assembly tool further includes a second swing arm link, the first and second swing arm links forming a pair of swing arm links located on opposite sides of the handle, the second pivot extending from the first swing arm link through the handle to the second swing arm link.

11. The compression assembly tool according to claim 1 wherein the handle includes first and second handle plates extending outward from a gripping end of the handle, the third pivot extending from the first handle plate through the plunger to the second handle plate.

12. The compression assembly tool according to claim 1 wherein the handle includes first and second handle plates extending outward from a handle block positioned between the first and second handle plates to form a gripping end of the handle.

13. The compression assembly tool according to claim 1 wherein:

the body includes first and second opposed body plates separated by a nose block;

the swing arm link is a first swing arm link and the compression assembly tool further includes a second swing arm link, the first and second swing arm links forming a pair of swing arm links located inside the body plates, the first pivot extending from the first body plate through the first and second swing arm links to the second body plate; and the handle includes first and second handle plates extending outward from a gripping end of the handle, the second pivot extending from the first swing arm link through the first and second handle plates to the second swing arm link and the third pivot extending from the first handle plate through the plunger to the second handle plate.

14. The compression assembly tool according to claim 1 wherein:

the body includes a pair of opposed body plates separated by a nose block and a body block, the nose block and body block being located on opposite sides of the compression region;

the nose block includes a U-shaped opening for receiving the cable and a pair of slots for receiving the split base supports;

the body block includes a handle extension and a plunger opening for receiving the plunger;

the body plates also include handle extensions on opposite sides of the body block, the handle extension of the body block and the body plates forming a second handle.

15. The compression assembly tool according to claim 1 wherein the body includes a pair of opposed body plates separated by a nose block and a body block, the nose block and body block being located on opposite sides of the compression region, each body plate having a compression region opening defining an O-frame on each side of the compression region.

16. The compression assembly tool according to claim 1 wherein the first pivot is located closer to the split base supports than the second or third pivots.

17. The compression assembly tool according to claim 1 wherein the plunger has a front contact surface defining a moving plunger contact plane as the plunger moves from the retracted position to the extended position, and wherein the first pivot is located on an opposite side of the plunger contact plane from the second and third pivots when the plunger is in the retracted position.

18. The compression assembly tool according to claim 1 wherein the body includes a pair of opposed body plates separated by a nose block and the nose block includes a pair of split base slots for receiving the split base supports and at least one corresponding pair of split base guides adjacent to the split base slots and extending outward from the nose block and into engagement with the opposed body plates.

19. The compression assembly tool according to claim 18 wherein the nose block includes two pairs of split base guides extending outward from the nose block and into engagement with the opposed body plates.

20. The compression assembly tool according to claim 1 further including a second pair of split base supports, the second pair of split base supports being located farther from the plunger than the first pair of split base supports.

21. The compression assembly tool according to claim 20 wherein the first pair of split base supports are pivotally attached to the body through a first pair of corresponding base support pivots and the second pair of split base supports are pivotally attached to the body through a second pair of corresponding base support pivots.

22. The compression assembly tool according to claim 21 wherein the first pair of split base supports include a corresponding first pair of split base stops, the first pair of split base stops being located on an opposite side of the pivotal attachment of the first pair of split base supports to the body from the split base opening for the cable of the first pair of split base supports and the second pair of split base stops being located on an opposite side of the pivotal attachment of the second pair of split base supports to the body from the split base opening for the cable of the second pair of split base supports.

23. The compression assembly tool according to claim 22 further including a first spring urging the first pair of split base stops apart and into contact with the body, and a second spring urging the second pair of split base stops apart and into contact with the body, the contact between the body and each split base stop defining a final predetermined location for each split base stop independent of the position of the other split base stops.

24. A compression assembly tool for attaching a connector to a cable by axially compressing the connector, the compression assembly tool comprising:

a body having an open portion defining a compression region for receiving the connector;

a first pair of split base supports attached to the body at an end of the compression region, the first pair of split base supports defining a split base opening for receiving the cable and a perimeter of the split base opening acting to support an end of the connector as the connector is compressed;

a handle;

a plunger mounted for longitudinal sliding motion relative to the body, the plunger being driven by the handle between an extended position to axially compress the connector and a retracted position to allow the connector to be removed from the compression region, the plunger having a front contact surface defining a plunger contact plane; and a swing arm link, the swing arm link being pivotally connected to the body through a first pivot and pivotally connected to the handle through a second pivot;

the plunger being pivotally connected to the handle through a third pivot, the first pivot being located on an opposite side of the plunger contact plane from the second and third pivots when the plunger is in the retracted position.

25. A compression assembly tool for attaching a connector to a cable by axially compressing the connector, the compression assembly tool comprising:

a body having an open portion defining a compression region for receiving the connector;

a first pair of split base supports attached to the body at an end of the compression region, the first pair of split base supports defining a split base opening for receiving the cable and a perimeter of the split base opening acting to support an end of the connector as the connector is compressed;

a handle;

a plunger mounted for longitudinal sliding motion relative to the body, the plunger being driven by the handle between an extended position to axially compress the connector and a retracted position to allow the connector to be removed from the compression region; and a swing arm link, the swing arm link being pivotally connected to the body through a first pivot and pivotally connected to the handle through a second pivot;

the plunger being pivotally connected to the handle through a third pivot and wherein the first pivot is located closer to the split base supports than the second pivot or the third pivot.

26. A compression assembly tool for attaching a connector to a cable by axially compressing the connector, the compression assembly tool comprising:

a body having an open portion defining a compression region for receiving the connector;

a first pair of split base supports attached to the body at an end of the compression region, the first pair of split base supports defining a split base opening for receiving the cable and a perimeter of the split base opening acting to support an end of the connector as the connector is compressed;

a handle;

a plunger mounted for longitudinal sliding motion relative to the body, the plunger being driven by the handle between an extended position to axially compress the connector and a retracted position to allow the connector to be removed from the compression region; and a swing arm link, the swing arm link being pivotally connected to the body through a first pivot and pivotally connected to the handle through a second pivot, the swing arm link including a first arm section and an angled second arm section, the first pivot connecting the first arm section to the body and the second pivot connecting the second arm section to the handle;

the plunger being pivotally connected to the handle through a third pivot.

* * * * *